United States Patent [19]

Fujiwara et al.

[11] Patent Number: 4,770,615

[45] Date of Patent: Sep. 13, 1988

[54] SCREW COMPRESSOR WITH SCAVENGING PORT

[75] Inventors: Mitsuru Fujiwara; Taiji Hashimoto, both of Ibaraki; Akira Suzuki, Atsugi, all of Japan

[73] Assignee: Hitachi, Ltd., Tokyo, Japan

[21] Appl. No.: 905,956

[22] Filed: Sep. 11, 1986

[30] Foreign Application Priority Data

Oct. 21, 1985 [JP] Japan ..... 60-233247

[51] Int. Cl.[4] ..... F04C 18/16; F04C 29/00

[52] U.S. Cl. ..... 418/15; 418/201

[58] Field of Search ..... 418/15, 189, 201, 180

[56] References Cited

U.S. PATENT DOCUMENTS

| | | | |
|---|---|---|---|
| 2,620,968 | 12/1952 | Nilsson | 418/15 |
| 3,057,543 | 10/1962 | Marsden | 418/189 |
| 3,275,226 | 9/1966 | Whitfield | 418/189 |
| 3,423,017 | 1/1969 | Schibbye | 418/117 |
| 3,526,470 | 9/1970 | Swanson | 418/15 |
| 3,610,787 | 10/1971 | Borisoglebsky | 418/201 |
| 3,877,846 | 4/1975 | Lundberg | 418/201 |
| 4,042,310 | 8/1977 | Schibbye et al. | 418/201 |
| 4,487,563 | 12/1984 | Mori | 418/201 |
| 4,560,333 | 12/1985 | Fujiwara | 418/189 |

*Primary Examiner*—John J. Vrablik

*Attorney, Agent, or Firm*—Antonelli, Terry & Wands

[57] ABSTRACT

A screw compressor including a scavenging port, which is separate from a discharge port, located on or in a vicinity of a discharge-side end face of the working space of the casing, for scavenging gas therethrough from a compression chamber near to a completion of a suction stroke. Gas of high temperature leaking from a compression chamber on high-pressure side into a compression chamber on a low-pressure side (in the suction stroke) can be scavenged from the compressor to outside, thereby avoiding a reduction in suction volume efficiency, an increase in consumption of power, and a rise in temperature of gas to be compressed which might otherwise be caused by the gas of high temperature leaking into the compression chambers during a suction stroke.

10 Claims, 9 Drawing Sheets

SCREW COMPRESSOR WITH SCAVENGING PORT

BACKGROUND OF THE INVENTION

The present invention relates to a screw compressor suitable for use in producing high-pressure air or high-pressure gas and for raising the pressure of a refrigerant in a gaseous state.

A typical screw compressor is shown in, for example, U.S. Pat. No. 3,423,017, wherein, a pair of rotors are each formed with a plurality of spiral lands or lobes, and a plurality of grooves are defined between the lobes which constitute compression chambers. An outer peripheral portion and end portions of the two rotors are positioned close to an inner wall surface of a rotor casing with a small gap existing therebetween except at a location of a gas suction port and a gas discharge port, so that the two rotors are substantially enclosed by the rotor casing. Due to this construction, the grooves formed on the rotors provide closed spaces other than suction and discharge strokes, and each space undergoes a change in volume (reduction) as the rotors rotate to enable the gas to be drawn by suction, compressed and discharged from the compression chamber.

In the aforementioned compressor of the type, gaps are defined between the two rotors and between the two rotors and rotor casing. In this construction, the gas of high temperature leaks from the grooves on the higher pressure side to the grooves on the lower pressure side. Additionally, the gas of high temperature leaks into the groove in suction stroke and occupies a part of the groove, thereby reducing the suction efficiency of the compressor.

Presuming, for example, that the commpressor is a single-stage, oilless air compressor of a discharge pressure of 7 kg/cm$^2$, discharged air has a temperature of more than 300° C., and when the air leaks through the gaps, the volume of the amount of the air leaked into the groove in suction stroke would be about twice as much in comparison with a volume of the same amount of air at suction temperature, because the air shows almost no change in temperature before and after passing through the gap. Thus, the weight of air in the groove at completion of the suction stroke becomes smaller as compared with a case in which leakage is not occurred. The work of compressing air from the suction state to the discharge pressure level has almost nothing to do with the temperature of air when the volumes of air to be compressed are the same. However, the higher the temperature of air at the completion of the suction stroke, the lower the weight of air becomes even if the volumes are the same. This means that the work per unit air weight increases and decreases efficiency of the compressor.

The above description has been provided in connection with an air compressor by way of example; however, it will be appreciated that this is not an isolated phenomenon and that the same problem would be encountered when a gas other than air is compressed.

SUMMARY OF THE INVENTION

A principal object of the invention is to minimize adverse effects of a gas of a high temperature leaking, through gaps between the two meshing rotors, from the compression chambers in the compression stroke and to the discharge port to the compression chamber in the suction stroke, to thereby improve the volume efficiency of the compressor.

Another object of the invention is to scavenge, without consuming additional power, the gas of high temperature leaking into the compression chamber in the suction stroke from the high pressure side of the compressor such as the compression chambers in the compression stroke and the discharge port thereby improving the efficiency of the compressor to reduce the loss of power.

Still another object of the invention is to lower the temperature of a gas at a starting of the compression and the discharge temperature of the compressor, thereby reducing the thermal deformation of the rotors and rotor casing and increasing the reliability of the compressor.

In order to attain the above objects, in accordance with the invention a scavenging port is provided on or in a vicinity of the discharge end face of the working space of the casing of the screw compressor. The scavenging port is independent of the discharge port and is communicated to a compression chamber in the suction stroke. The scavenging port functions to discharge the compressed gas of high temperature leaking from the high-pressure side of the compressor into the compression chamber, by utilizing the inertia of gas drawn by suction into the compression chamber.

DESCRIPTION OF THE PREFERRED EMBODIMENTS

Figure 1:
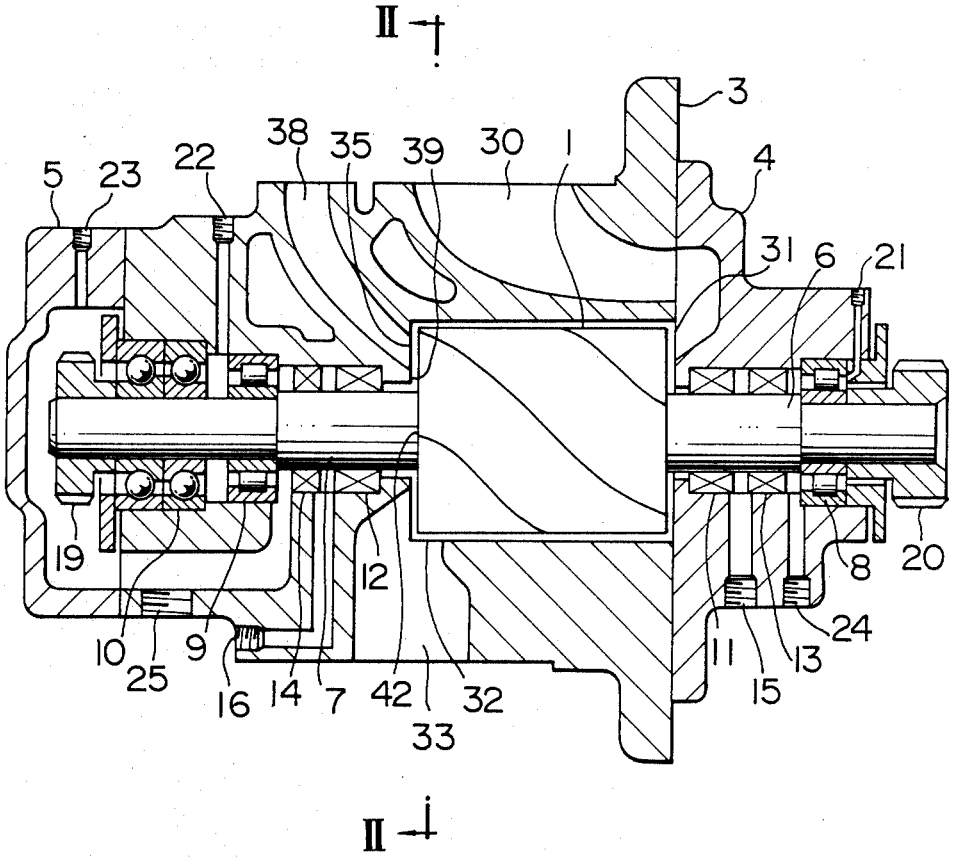
FIG. 1 is a transverse sectional view of one embodiment of the screw compressor according to the invention.
Figure 2:
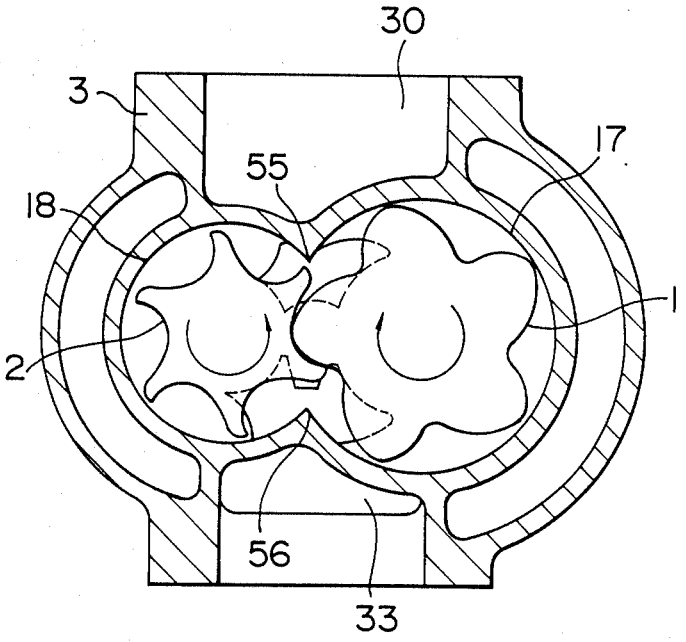
FIG. 2 is a sectional view taken along the line II—II in FIG. 1.

Referring now to the drawings wherein like reference numerals are used throughout the various views to designate like parts and, more particularly, to FIGS. 1 and 2, according to these figures, a screw compressor includes a male rotor 1 and a female rotor 2, with the male rotor 1 including a cylindrical body formed at an outer peripheral surface thereof with a plurality of lands or lobes and a plurality of grooves defined by the lobes, and the female rotor 2 also including a cylindrical body formed at an outer peripheral surface thereof with a plurality of lands or lobes and a plurality of grooves deinfed by the lobes. A rotor casing 3, a suction casing 4 connected to the suction side of the rotor casing 3 and a discharge cover 5 covering the discharge end of the male and female rotors 1 and 2 are also provided. The male and female rotors 1 and 2 each have a shaft 6 on the suction side and a shaft 7 on the discharge side. The shaft 6 on the suction side are journaled by cylindrical roller bearings 8 and the shaft 7 on the discharge side by cylindrical roller bearings 9 and a combined angular ball bearings 10. The shafts 6 and 7 on the suction and discharge sides are respectively provided with shaft seal means 11 and 12 in order to air-tighly seal the compression chambers . Oil shield means 13 and 14 are provided to the shafts 6 and 7 respectively, to prevent a lubricant for the bearings from leaking into the compression chambers from shaft sealing sections.

A lubricant might leak from the oil shield means 13 and 14 and, to avoid such lubricant invading the shaft sealing sections, gas vents 15 and 16 are located between the shaft seal means 11 and oil shield means 13 and between the shaft seal means 12 and oil shield means 14, respectively. The construction of the shaft sealing sections is described in detail in, for example U.S. Pat. No. 4,487,563.

Referring to FIG. 2, the male rotor 1 and female rotor 2 which mesh with each other rotate in two bores 17 and 18, respectively, which intersect each other. A timing gear 19, shown in FIG. 1, is connected to one end of the shaft 7 connected to the discharge end of the male rotor 1 and maintain in meshing engagement with another timing gear, not shown, connected to one end of the shaft 7 connected to the discharge end of the female rotor 2. The two timing gears enable the male and female rotors 1 and 2 to rotate synchronously through a small gap in the respective bores 17 and 18 without contacting each other.

A pinion 20 is connected to one end of the shaft connected to the suction end of the male rotor 1 and driven from an external drive source, such as an electric motor, so as to rotatably drive the male rotor 1.

A lubricant is fed from oil feeding holes 21, 22 and 23 to the bearing 8 on the suction side, the bearings 9 and 10 on the discharge side and the timing gear 19, respectively. The lubricant is discharged through oil discharging holes 24 and 25 after lubricating the bearings or gear.

Figure 3:
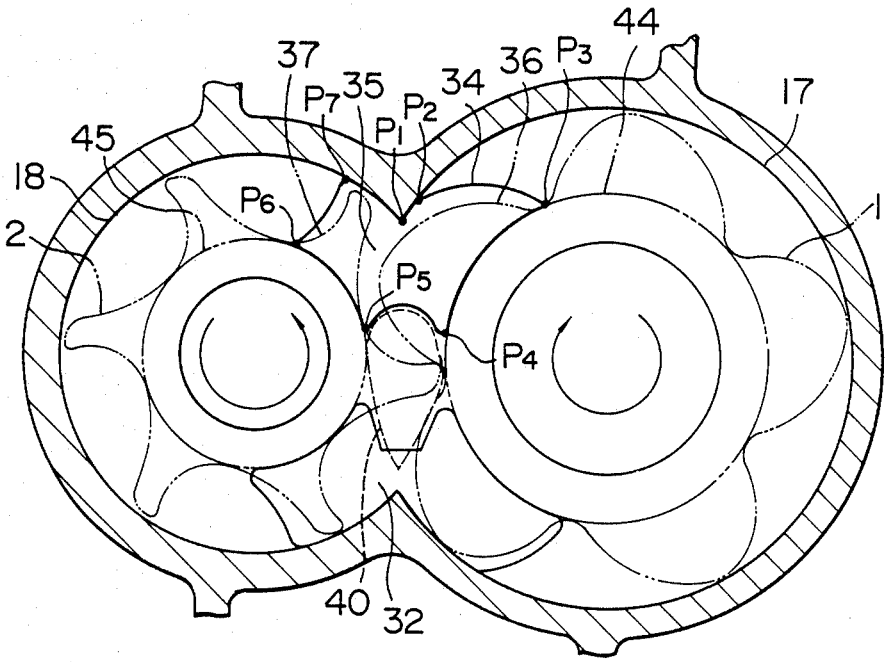
FIG. 3 is a sectional view, on an enlarged scale, of a vicinity of a discharge end of a casing bore of the screw compressor of FIG. 1.

A gas is drawn by suction through a suction chamber 30 and a suction port 31 into the grooves on the two rotors 1 and 2 which define compression chambers. After being compressed in the compression chambers, the gas is released through a discharge port 32 into a discharge chamber 33. A scavenging port 35 is formed at a casing portion 39 which faces a discharge end face 42 of the two rotors 1 and 2. The scavenging port 35 is located at the discharge end of the bores 17 and 18 and configured as indicated by the reference numeral 34. In FIG. 3, a section $P_1$–$P_2$ and a section $P_7$–$P_1$ coincide with outer circumferences of the male and female rotors 1 and 2 respectively, and a section $P_3$–$P_4$ and a section $P_5$–$P_6$ coincide with root circles of the male and female rotors 1 and 2, respectively. A section $P_2$–$P_3$ substantially coincides with a configuration of a leading flank 36 of the male rotor 1 when male rotor 1 is in a phase in which its groove is to be closed from the scavenging port 35 or when the male rotor 1 completes its suction stroke. Meanwhile a section $P_6$–$P_7$ substantially coincides with the configuration of a trailing flank 37 of the female rotor 2 when the female rotor 2 is in a phase in which its groove is to be closed from the scavenging port 35 or when the male rotor 1 completes its suction stroke. The sections $P_2$–$P_3$ and $P_6$–$P_7$ of the scavenging port 35 do not necessarily need to be coincided with the tooth profile of the male and female rotors 1 and 2 too strictly, and the rotor profile may be aproximated by a quadratic curve, such as an arc, a parabolic curve, etc., or a polygonal line. The time at which the leading flank 36 of the male rotor 1 reaches the edge of the scavenging port 35 in the section $P_2$–$P_3$ do not need to coincide with the time at which the trailing flank 37 of the female rotor 2 reaches the edge of the scavenging port 35 in the section $P_6$–$P_7$. The timing may be varied independence upon the circumstances.

A closed curve 40, shown in a phantom line, represents a locus of the points of contact between the male and female rotors 1 and 2 as projected on to a plane perpendicular to the rotor axis and is generally referred to as a seal line. The scavenging port 35 should be configured such that it does not cross the closed curve 40. In the embodiment shown and described herein, a section $P_4$–$P_5$ of the scavenging port 35 is in the form of a curve which is disposed close to the seal line 40 on the outer side thereof.

Figure 4A:
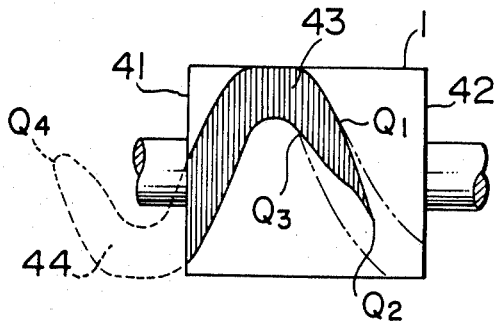
FIGS. 4*a* and 4*b* are views in explanation of the operation of the screw compressor shown in FIG. 1.

In FIG. 4*a*, the male rotor 1 has a suction end face 41 in addition to the discharge end face 42. A hatched area 43 represents a compression chamber projected onto a plane parallel to the axis of the male rotor 1 at a given angle of rotation. A curve extending from $Q_1$ to $Q_3$ through $Q_2$ is a seal line between the male and female rotors 1 and 2.

The groove on the rotors is extended from the suction end face to the discharge end face. The groove on the male and female rotors 1 and 2 is divided into separate compression chambers at the seal line according to the meshing of the male and female rotors 1 and 2.

Figure 4B:
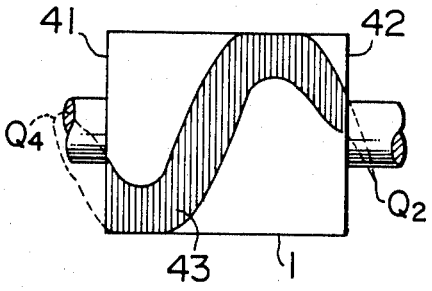

Due to the nature of the screws, the meshing portion of the male and female rotors 1,2 axially move in parallel motion from the suction end face 41 toward the discharge end face 42. Not only the meshing portion, but also the groove on the male and female rotors 1,2 moves axially in parallel motion as a whole. As a result, the groove comes to a position shown in FIG. 4*b* after the rotors have moved through a certain angle. Areas shown in phantom lines in FIGS. 4*a* and 4*b* represent imaginary portions of the working chamber extended by assuming that the rotors have a great length. The phantom line portions do not actually exist in the rotors of this embodiment. However, as the rotors rotate, the phantom line portions become compression chambers which actually exist as if they moved in parallel motion axially of the rotors from outside the rotors.

When the point $Q_2$ is disposed outside the suction end face 41, the compression chamber 43 does not yet exist. The compression chamber 43 appears on the rotors when the point $Q_2$ has reached the suction end face 41 and its volume successively increased thereafter. As the point $Q_2$ passes through the discharge end face 42, the portion of the compression chamber extending out of the discharge end face 42 disappears. Thus, the volume of the compression chamber is reduced by an amount corresponding to the disappeared portion thereof. However, the volume of the compression chamber continues to increase for a while because the volume of the compression chamber increases at the suction end face 41 by an amount greater than the decreased volume. After the increase has reached the peak level, the volume of the compression chamber begins to decrease and it becomes zero when a point $Q_4$ reaches the discharge end face 42.

The suction stroke of the screw compressor is started immediately after the point $Q_2$ passes through the suction end face 41 and continues until the compression chamber is shut off from the suction port 31. Usually the suction port 31 is positioned such that the compression chamber is closed (it is closed from both the suction port 31 and the discharging port 32) in the vicinity of the time when its volume is maximum.

As described hereinabove, the compression chamber of the screw compressor moves in parallel motion as the rotors rotate, so that the compression chamber axially moves in uniform velocity in the case where the lead is constant and the rotational speed of the male and female rotors 1,2 is also constant. In FIG. 4*a*, the compression chamber 43 moves in parallel motion from the suction end face 41 toward the discharge end 42 while drawing a gas by suction through the suction port 31. Presuming that the compression chamber is closed by the walls of the casings 3 at the discharge end face 42 as is the case with compression chamber of screw compressors of the prior art, when the point $Q_2$ reaches the discharge end face 42, the gas in the compression chamber in the vicinity of the discharge end face 42 is blocked and its pressure rises. In the embodiment shown and described herein, the scavenging port 35 is located in a portion of the rotor casing 3 which faces the discharge end face 42 of the rotors as shown in FIG. 1. By virtue of this feature, the gas flows, by inertia, through the scavenging port 35 into a scavenging chamber 38. At this time, the gas in the compression chambers located in the vicinity of the discharge end face 42 is mostly a gas of high temperature leaked from the high pressure side of the screw compressor, so that the gas of high temperature accounts for the major portion of the gas scavenged from the compression chamber through the scavenging port 35. Meanwhile, the suction port 31 is still open at this time, so that a fresh gas is introduced into the compression chamber from the suction chamber 30. Thus, the hot gas can be replaced by the fresh gas as the former is scavenged through the scavenging port 35.

When the rotors 1 and 2 further rotate, the male and female compression chamber is shut off from the scavenging port 35, thereby finishing the scavenging of the hot gas from the compression chamber. This corresponds to the time when the leading flank 36 of the male rotor 1 and the trailing flank 37 of the female rotor 2 pass through the sections $P_2$–$P_3$ and $P_6$–$P_7$ of the scavenging port 35, respectively.

The timing when the compression chamber is shut off from the scavenging port 35 is at the same time when the compression chamber is shut off from the suction port 31 or just before the time. If the compression chamber is shut off from the scavenging port 35 after it is shut off from the suction port 31, the gas in the compression chamber becomes thin, causing a reduction in the efficiency of the compressor. In addition, the gas to be scavenged backflows, thereby making it impossible for the scavenging port 35 to achieve the desired results.

Moreover, because the scavenging port 35 does not include the inner portion of the closed curve 40 obtained by projecting on to a plane perpendicular the axis of the rotors the locus of meshing portions of the male and female rotors 1 and 2, there is not opportunity for the scavenging port 35 and other compression chamber in high pressure to be communicated with each other.

In the embodiment shown and described herein, a gas is axially drawn by suction through the suction end of the male and female rotors 1 and 2 and scavenged axially through the scavenging port 35. In this construcion, the momentum of the gas drawn by suction can be effectively utilized for scavenging the gas from the compression chambers through the scavenging port 35. This is conducive to improved efficiency because no additional power consumption is involved.

Figure 5:
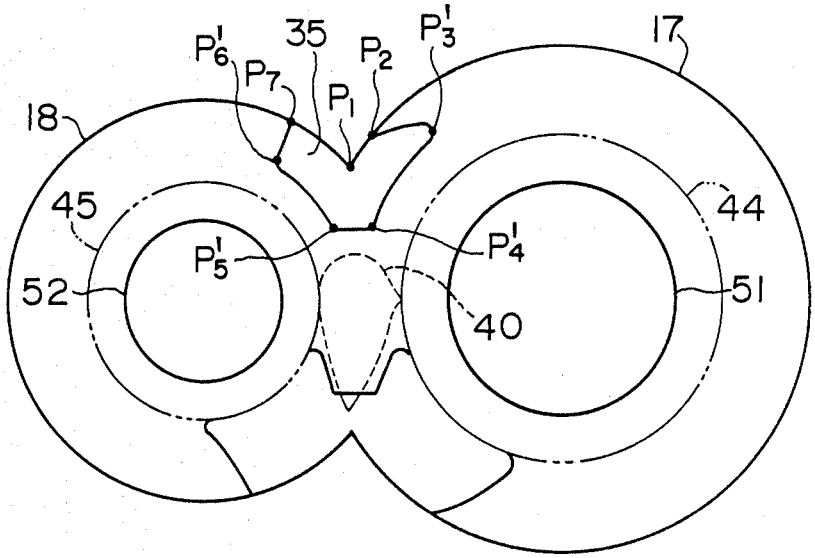
FIG. 5 is a partially enlarged view of another embodiment of the screw compressor according to the inventio with rotors omitted.

As shown in FIG. 5, the scavenging port 35 is configured such that, although the sections $P_1$–$P_2$ and $P_7$–$P_1$ are the same as the sections of the embodiment shown in FIG. 3, there are some alterations in the configuration of the scavenging port 35. The section $P_3$–$P_4$ of the embodiment shown in FIG. 3 is replaced by a section $P_3'$–$P_4'$ in the embodiment shown in FIG. 5 which is spaced from a root circle 44 of the male rotor. Likewise, a section $P_5'$–$P_6'$ shown in FIG. 5 is spaced aprt from a root circle 45 of the female rotor. A section $P_4'$–$P_5'$ shown in FIG. 5 is spaced apart from the seal line 40.

Figure 6:
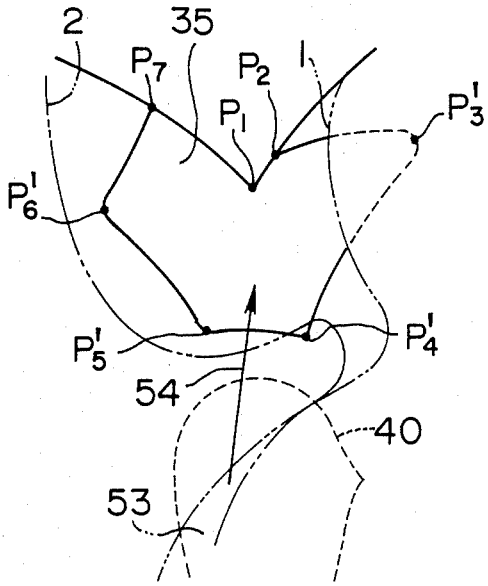
FIG. 6 is a view in explanation of the operation of the embodiment shown in FIG. 5.

Leakage from the discharge end face of a screw compressor usually occurs through a narrow parallel gap between the end face of the male and female rotors and the inner wall surface of the casing. When this gap is large, the amount of gas leaking from the groove of high pressure to the groove of the low pressure is great. The gas leaking in this manner may include a gas leaking through a hole 51 for receiving the shaft of the male rotor or a hole 52 for receiving the shaft of the female rotor. The gas leakage through the shaft holes 51 and 52 can be reduced by spacing the scavenging port 35 from the shaft holes 51 and 52 as shown in FIG. 5. This is also true of the seal line 40. Gas leakage through the end face of the rotors can be reduced by spacing the scavenging port 35 from the seal line 40. In a manner illustrated in FIG. 6. When the male and female rotors 1 and 2 mesh with each other as shown in FIG. 6, a high pressure compression chamber 53 is formed, so that the gas might leak in a direction of an arrow 54 through the gap between the end face of the rotors and the casing. In the embodiment shown in FIG. 5, the scavenging port 35 is spaced apart from the seal line 40 and the passage of the gas leakage is longer than in the embodiment shown in FIG. 3 in which the scavenging port 35 is close to the seal line 40. This is conducive to a reduction in the amount of gas leakage.

Figure 7:
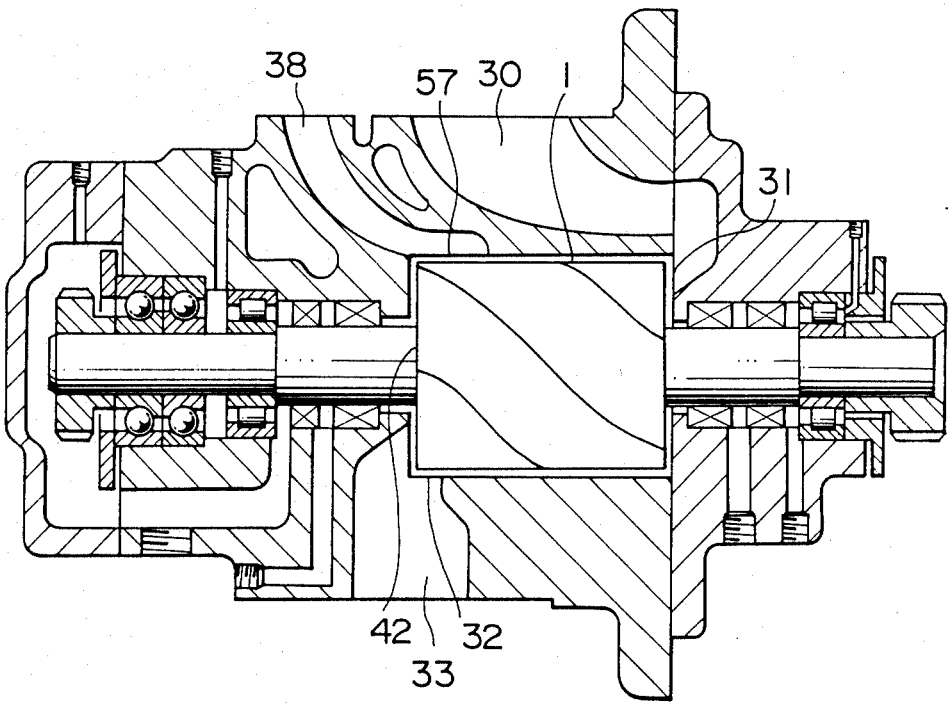
FIG. 7 is a transverse sectional view of still another embodiment of the screw compressor comprising according to the invention.
Figure 8A:
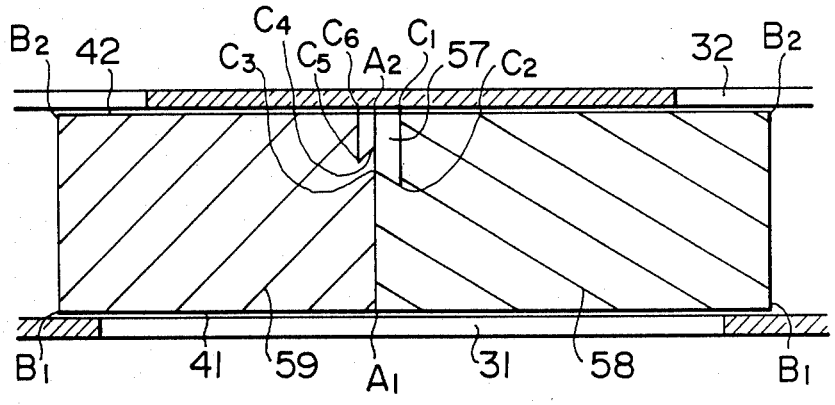
FIGS. 8*a* and 8*b* are developed views of the casing bores of the compressor shown in FIG. 7.

In the embodiment of FIG. 7 a scavenging port 57 opens on outer peripheral surfaces of the male and female rotors 1 and 2. The configuration of the scavenging port 57 which will hereinafter be referred to as a radial scavenging port will be described in connection with FIG. 8*a* in which the bores defined in the rotor casing are shown in a developed view with the rotors having a suction end 41 and a discharge end 42. A line connecting points $A_1$–$A_2$ is a line of intersection between the bores of the rotor casing on the suction side, and a line connecting points $B_1$–$B_2$ is a line of intersection between the bores of the rotor casing on the discharge side. The lines $A_1$–$A_2$ and $B_1$–$B_2$ correspond to points 55 and 56 respectively in FIG. 2, with the 58 and 59 representing spiral lines at the crest of the lobes of the rotors. The edge of the radial scavenging port 57 includes sections $C_1$–$C_2$ and $C_5$–$C_6$ which are straight lines parallel to the axes of the rotors, sections $C_2$–$C_3$ and $C_4$–$C_5$ which are straight lines parallel to the lines 59 and 59 respectively, a section $C_3$–$C_4$ which is a portion of the line $A_1$–$A_2$ and a section $C_1$–$C_6$ which is a portion of a line of intersection between a plane including the discharge end face of the rotors and the bores of the rotor casing.

Figure 8B:
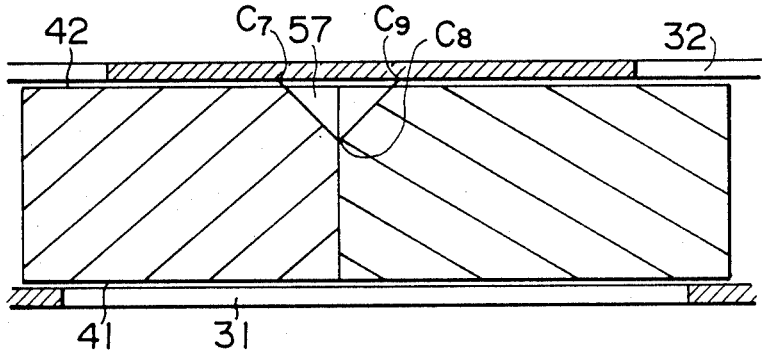

The edge of the radial scavenging port 57 may be simplified, if necessary, into a triangular shape as shown in FIG. 8*b*. The shape is not limited to the triangular shape and any other shape, such as a circular shape, may be adopted to facilitate the operation of forming the radial scavenging port 57 in the rotor casing.

When the radial scavenging port 57 is provided, the discharge end face 42 of the rotors is entirely closed by walls of the casing 3 and 4 except for a portion where the discharge port 32 is located. This further reduces the gas leakage through the discharge end face 42 described in connection with FIG. 5. As centrifugal forces are exerted on the gas in the compression chambers and the discharge end face 42 is closed to block the flow of gas causing the pressure of gas to rise, the gas can be scavenged from the outer peripheral surfaces of the rotors.

The construction and operation of the scavenging port according to the invention and the advantages offered by this feature have been described. In actual practice, a problem would be encountered as to how to dispose of the gas scavenged from the scavenging port.

Figure 9:
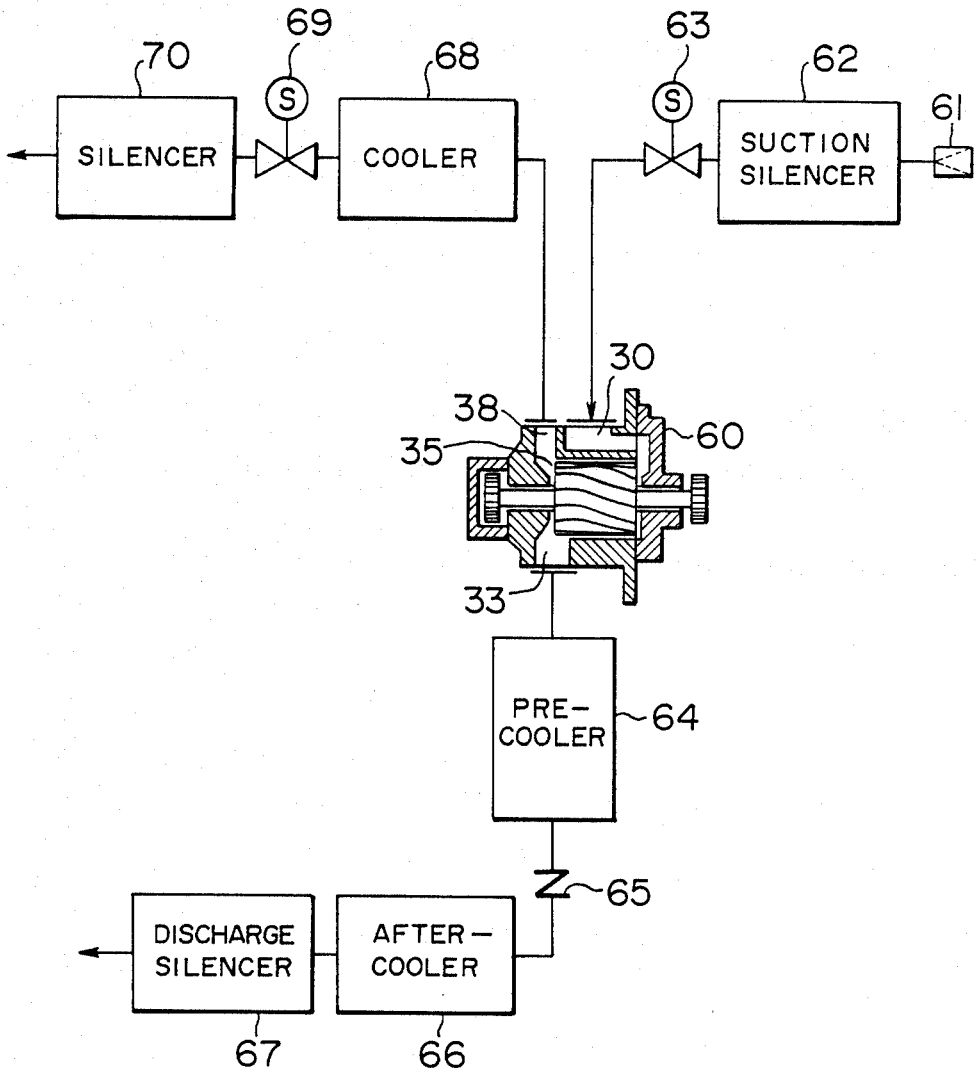
FIG. 9 and 10 are systematic views of further embodiments of the screw compressors according to the invention.

FIG. 9 shows another embodiment provided with means for solving the problem of disposal of air scavenged from an air compressor. Air is drawn by suction from the atmosphere through a suction filter 61, a suction silencer 62 and a suction throttle valve 63 into the compressor 60. After being compressed, the air of high pressure is supplied from a discharging chamber 33 through a pre-cooler 64, a check valve 65, an after-cooler 66 and a discharge silencer 67 to a line. By mounting a blower on the suction side (at an arbitrarily selected location between the suction filter 61 and suction chamber 30) and supercharging the sucked air, it is possible to satisfactorily perform the scavenging operation (for scavenging through the scavenging port air of high temperature leaked into the compression chamber in the suction stroke). The air of high temperature scavenged in this way is released into the atmosphere after flowing through a cooler 68, a valve 69 and a silencer 70. When the air to be scavenged is not so high in temperature, the cooler 68 may be omitted. Also, it is possible to release the scavenged air to outside after mixing the same with exhaust of a motor fan or exhaust of heat radiating equipment of an air conditioning system.

In air compressors, operation is performed in many cases by throttling the suction-side valve 63 or fully closing the same to adjust the amount of air, when an unloading operation is performed. At this time, suction pressure decreases. Thus, if the scavenging port 35 is maintained in communication with the atmosphere, air might be introduced from the atmosphere to backflow into the scavenging chamber 38 from the silencer side 70, making it impossible to perform an unloading operation. Therefore, the valve 69 if fully closed when an unloading operation is performed.

Figure 10:
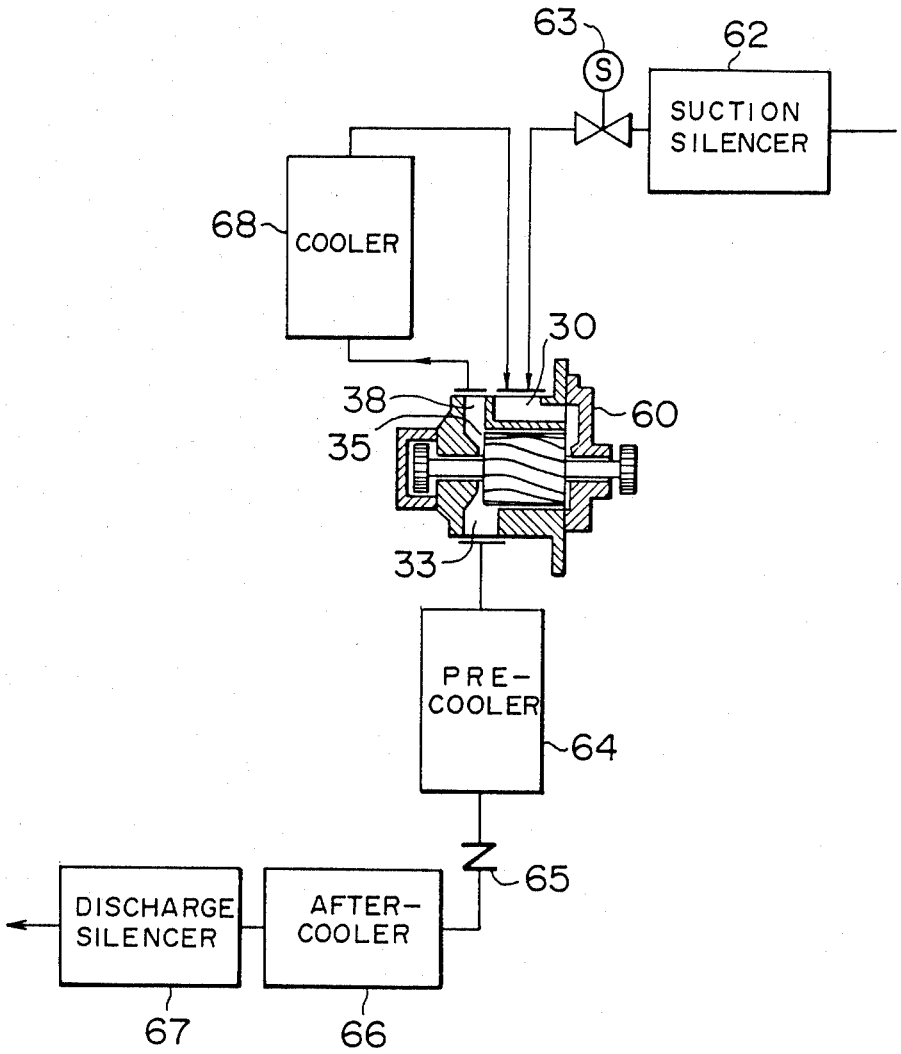

FIG. 10 shows a further embodiment provided with means for solving the problem of disposal of the scavenged air. The gas scavenged through the scavenging port 35 is returned to the suction chamber 30 of the compressor after being cooled by the cooler 68. This is advantageous in the case of a refrigerant compressor or a helium compressor in which the scavenged gas cannot be released into the atmosphere. This is also advantageous in the case of an air compressor because the silencer for the scavenged air can be omitted since the noises are not produced by the air scavenged into the atmosphere.

The embodiment shown in FIG. 10 can have application in an oil cooling compressor in which oil is supplied into the bores in the rotor casing.

From the foregoing description, it will be appreciated that according to the invention the major portion of gas of high temperature leaked into a rotor groove in the suction stroke from the high pressure side of the compressor is scavenged from the rotor groove and a reduction in the flow rate (weight) of sucked-in gas which might otherwise be caused to occur by the expansion of the leaked gas of high temperature is substantially eliminated, thereby improving efficiency as compared with compressors of the prior art.

What is claimed is:

1. A screw compressor comprising:

a casing having two intersecting bores defining a working space, a suction port communicating with said working space at one end thereof and a discharge port communicating with said working space at an opposite end thereof; and a male rotor and a female rotor formed with a plurality of lobes arranged spirally and defining a plurality of rotor grooves therebetween, said male and female rotors being located in said working space in mesh with each other to define a plurality of compression chambers between the two rotors and the casing;

whereby gas is drawn into each of said plurality of compression chambers through the suction port while the compression chamber is maintained in communication with the suction port as the male and female rotors meshing with each other rotate, the gas in the compression chamber is compressed from a time when the compression chamber is shut off from the suction port and completes a suction stroke as the rotation of the rotors progresses to a time when the compression chamber is brought into communication with the discharge port, and the gas in the compression chamber is discharged to the discharge port while the compression chamber is maintained in communication with the discharge port, wherein the improvement comprises;

a scavenging port provided on or in a vicinity of a discharge end face of the working space of said casing and having a time period during which said scavenging port is communicated with a compression chamber in a suction stroke before said compression chamber completes said suction stroke, said scavenging port being in communication with an exterior of the casing for scavenging a part of the gas in said compression chamber out of the working space in said time period.

2. A screw compressor as claimed in claim 1, wherein said scavenging port communicates with a compression chamber of the plurality of compression chambers which is immediately before the suction stroke is completed.

3. A screw compressor as claimed in claim 1, wherein said scavenging port is located at a discharge-side end face of the working space of the casing.

4. A screw compressor as claimed in claim 3, wherein said scavenging port includes a curve extending along a seal line of the male and female rotors projected onto the discharge-side end face of the working space of the casing, an arc centered at a center of rotation of the female rotor and extending along a bottom of the groove of the female rotor, an arc centered at a center of rotation of the male rotor and extending along a bottom of the groove of the male rotor, a curve extending along a trailing flank of the groove of the female rotor, a curve extending along a leading flank of the groove of the male rotor, and curves extending along intersecting portions of inner wall surfaces of the two bores.

5. A screw compressor comprising:

a rotor casing having two intersecting bores defining a working space, a suction port communicating with said working space at one end thereof and a discharge port communicating with said working space at an opposite end thereof;

a suction-side casing connected to an end face of said rotor casing;

a male rotor accommodated in said working space, said male rotor having a plurality of lobes and grooves located spirally on an outer peripheral surface of a cylindrical portion and two shaft ports each connected to one of the opposite ends of the cylindrical portion;

a female rotor accommodated in said working space being meshed with said male rotor, said female rotor having a pluarlity of grooves and lobes located spirally on an outer peripheral surface of a cylindrical portion and two shaft portions each connected to one of opposite ends of the cylindrical portion, the grooves and lobes of the female rotor being formed to mesh with the lobes and grooves of the male rotor;

bearing means located between each shaft portion of the two rotors and the rotor casing and suction-side casing for rotatably journaling said male and female rotors; and scavenging port means for communicating with one of a plurality of compression chambers defined between said male and female rotors and said two casings, said one of said plurality of compression chambers being in communication with the scavenging port means immediately before said one compression chamber completes its communication with the suction port, and wherein said scavenging port is provided on or in a vicinity of a discharge end face of the working space of the casing and is in communication with an exterior of the casing of the screw compressor.

6. A screw compressor as claimed in claim 5, wherein said scavenging port means comprises a scavenging port formed at a discharge-side end face of the working space in the rotor casing.

7. A screw compressor as claimed in claim 6, wherein said scavenging port includes a curve extending along a seal line of the two rotors projected onto the discharge-side end face of the working space of the casing, an arc centered at a center of rotation of the female rotor and extending along a bottom of the groove of the female rotor, an arc centered at a center of rotation of the male rotor and extending along a bottom of the groove of the male rotor, a curve extending along a trailing flank of the groove of the female rotor, a curve extending along a leading flank of the groove of the male rotor, and curves extending along intersecting portions of inner wall surfaces of the two bores.

8. A screw compressor comprising:

a rotor casing having two intersecting bores defining a working space, a suction port communicating with said working space at one end thereof and a discharge port communicating with said working space at an opposite end thereof; and a suction-side casing connected to an end face of said rotor casing;

a male rotor accommodated in said working space, said male rotor having a plurality of lobes and grooves located spirally on an outer peripheral surface of a cylindrical portion and two shaft portions each connected to one of opposite ends of the cylindrical portions;

a female rotor accommodated in said working space being meshed with said male rotor, said female rotor having a plurality of grooves and lobes located spirally on an outer peripheral surface of a cylindrical portion and two shaft portions each connected to one of opposite ends of the cylindrical portion, the grooves and lobes of the female rotor being formed to mesh with the lobes and grooves of the male rotor;

bearing means located between each shaft portion of the two rotors and the casing for rotatably journaling said male and female rotors;

shaft sealing means for air-tightly sealing the compression chambers located between each shaft portion of the male and female rotors and the rotor side casing and suction-side casing;

oil shield means for preventing lubricant for said bearing means from leaking into the compression chambers located between each shaft portion of the two rotors and the rotor side casing and suction-side casing;

a pair of timing gears each mounted to one of the two shaft portions of the male and female rotors to mesh with each other to cause the male and female rotors to be rotated in synchronism with each other; and scavenging port means for communicating with one of a plurality of compression chambers defined between said male and female rotors and said rotor side casing and suctions-side casing, said one compression chamber being in communication with said scavenging port means immediately before completion of its communication with the suction port, and wherein said scavenging port means is provided on or in a vicinity of a discharge end face of the working space of the casing and is in communicating with an exterior of the casing of the screw compressor.

9. A screw compressor as claimed in claim 8, wherein said scavenging port means comprises a scavenging port located at a discharge-side end face of the working space of the rotor casing.

10. A screw compressor as claimed in claim 8, wherein said scavenging port means comprises a scavenging port which is configured to include a curve extending along a seal line of the two rotors projected onto the discharge-side end face of the working space of the rotor casing on an arc centered at a center of rotation of the female rotor and extending along a bottom of the groove of the female rotor, an arc centered at a center of rotation of the male rotor and extending along a bottom of the groove of the male rotor, a curve extending along a trailing flank of the groove of the female rotor, a curve extending along a leading flank of the groove of the male rotor, and curves extending along intersecting portions of inner wall surfaces of the two bores.

* * * * *